US009523064B2

(12) United States Patent
Job et al.

(10) Patent No.: US 9,523,064 B2
(45) Date of Patent: Dec. 20, 2016

(54) ANTI-GREYING DETERGENT

(71) Applicant: Henkel AG & Co. KGaA, Duesseldorf (DE)

(72) Inventors: Mareile Job, Leverkusen (DE); Birgit Gluesen, Duesseldorf (DE); Christian Kropf, Hilden (DE); Bent Rogge, Duesseldorf (DE); Michael Strotz, Cologne (DE); Thomas Heinze, Jena (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 14/823,166

(22) Filed: Aug. 11, 2015

(65) Prior Publication Data

US 2015/0368591 A1 Dec. 24, 2015

Related U.S. Application Data

(63) Continuation of application No. PCT/EP2014/052398, filed on Feb. 7, 2014.

(30) Foreign Application Priority Data

Feb. 12, 2013 (DE) ..... 10 2013 202 269

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/00*** | (2006.01) |
| ***C11D 3/22*** | (2006.01) |
| ***C11D 3/34*** | (2006.01) |

(52) U.S. Cl.

CPC ..... *C11D 3/0036* (2013.01); *C11D 3/228* (2013.01); *C11D 3/3454* (2013.01)

(58) Field of Classification Search

CPC ..... C11D 1/02; C11D 1/66; C11D 1/83; C11D 3/0036; C11D 3/228; C11D 3/3454

See application file for complete search history.

(56) References Cited

U.S. PATENT DOCUMENTS

| | | | |
|---|---|---|---|
| 4,990,609 | A | 2/1991 | Herzog et al. |
| 5,278,304 | A | 1/1994 | Kniewske et al. |
| 2007/0225190 | A1 | 9/2007 | Scheibel et al. |

FOREIGN PATENT DOCUMENTS

| | | | | |
|---|---|---|---|---|
| WO | 2006/117056 A1 | | 11/2006 | |
| WO | WO 2006/117056 | * | 11/2006 | ..... C11D 3/22 |

OTHER PUBLICATIONS

PCT International Search Report (PCT/EP2014/052398) dated Apr. 17, 2014.

* cited by examiner

*Primary Examiner* — Brian P Mruk

(74) *Attorney, Agent, or Firm* — Thomas G. Krivulka

(57) ABSTRACT

An aqueous liquid detergent is proposed, containing a surfactant and optionally additional conventional constituents, said agent containing sulfoethyl cellulose having a substitution rate of 0.3 to 0.9 and/or the salt thereof.

6 Claims, No Drawings

ANTI-GREYING DETERGENT

FIELD OF THE INVENTION

The present invention generally relates to a liquid detergent containing a certain cellulose derivative as anti-greying active ingredient.

BACKGROUND OF THE INVENTION

Anti-greying agents have the task of keeping the dirt, that is detached from the fiber during the washing of textiles, suspended in the liquor, thus preventing the dirt from being redeposited on the textile. Water-soluble colloids, usually of organic nature, are suitable for this purpose, for example glue, gelatin, or salts of acidic sulfuric acid esters of cellulose or of starch. Water-soluble polyamides containing acidic groups are also suitable for this purpose. Furthermore, soluble starch preparations and starch products other than those mentioned above can be used, for example degraded starch, aldehyde starches, etc. Polyvinylpyrrolidone can also be used. Cellulose ethers such as carboxymethyl cellulose (Na salt), methyl cellulose, hydroxyalkyl cellulose, and mixed ethers such as methyl hydroxyethyl cellulose, methyl hydroxypropyl cellulose, methyl carboxymethyl cellulose and the mixtures thereof in quantities of normally 0.1 to 5% by weight, in relation to the detergent, are often also used.

Although the specified cellulose ethers have a good anti-greying effect, the use thereof in hydrous liquid detergents is highly restricted, such that they cannot be incorporated in such detergents in practice. Apart from their anti-greying effect, which only becomes relevant with use in the washing process, these cellulose ethers specifically have a comparatively low solubility in surfactant-containing systems and have a highly thickening effect on aqueous systems. When such cellulose ethers are incorporated, in concentrations desired for the anti-greying effect, into liquid detergents containing water and in particular containing anionic surfactant, either products that are no longer flowable and pourable are generally obtained, which products can only be handled by the user with additional effort, for example by providing individual metered portions packaged so as to be water-soluble or so as to be capable of being torn open and water-insoluble, or the cellulose ethers are, in particular after storage, not fully dissolved in the hydrous liquid detergent or are not uniformly dispersed therein, which, besides a poorly perceived aesthetic appearance, also leads to non-uniform metering of the anti-greying active ingredient in the case of application of the agent containing same.

International patent application WO 2006/117056 A1 discloses the use of celluloses that carry sulfoalkyl groups bonded via ether, ester or amide functions for prevention of redeposition in the washing of textiles.

It has now surprisingly been found that a good anti-greying effect without unacceptable viscosity increase or precipitation can be achieved in hydrous liquid detergents when sulfoethyl cellulose is used.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An aqueous liquid detergent containing a surfactant and also additional conventional constituents of detergents and cleaning agents, said agent containing sulfoethyl cellulose having a substitution rate of 0.3 to 0.9 and/or the salt thereof.

Use of sulfoethyl cellulose having a substitution rate of 0.3 to 0.9, in particular of 0.4 to 0.7, and/or the salt thereof in aqueous liquid detergents in order to improve anti-greying when washing textile fabrics.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The subject matter of the invention is an aqueous liquid detergent containing a surfactant and optionally additional conventional constituents of detergents and cleaning agents, said agent containing sulfoethyl cellulose having a substitution rate of 0.3 to 0.9, in particular of 0.4 to 0.7, and/or the salt thereof. This means that, on average, 0.3 to 0.9, in particular 0.4 to 0.7, sulfoethyl groups per anhydroglucose monomer unit are contained in the cellulose derivative. The average molar mass (weight average) of the cellulose derivatives used according to the invention preferably lies in the range from 5000 g/mol to 3,000,000 g/mol, in particular from 20,000 g/mol to 2,000,000 g/mol, particularly preferably in the range from 70,000 g/mol to 1,500,000 g/mol, and even more preferably in the range from 150,000 g/mol to 1,000,000 g/mol. The degree of polymerization or the molecular weight of the cellulose ether can be determined for example on the basis of the determination of the limiting viscosity number of sufficiently diluted aqueous solutions with the aid of an Ubbelohde capillary viscometer. From this, it is possible to calculate the degree of polymerization and also, with the inclusion of the substitution rates, the corresponding molecular weight. Alternatively, the molecular weight can be determined via size exclusion chromatography.

The sulfoethyl cellulose suitable according to the invention can be produced in the conventional manner by reacting cellulose with chloroethyl sulfonic acid or ethylene sulfonic acid in the appropriate mol equivalents. Suitable salts of sulfoethyl cellulose are in particular the alkaline salts, such as the sodium and potassium salts, but also the ammonium salts, of sulfoethyl cellulose.

An agent according to the invention preferably contains 0.1% by weight to 5% by weight, in particular 0.5% by weight to 3% by weight, of the specified sulfoethyl cellulose and/or the salts thereof.

The invention also relates to the use of the specified sulfoethyl cellulose and/or the salts thereof in aqueous liquid detergents in order to improve the anti-greying effect when washing textile fabrics using the aqueous liquid detergent.

The detergent according to the invention, besides the specified cellulose ether derivative and surfactants explained in greater detail hereinafter, also contains water in quantities, in relation to the total agent, of preferably up to approximately 85% by weight, and in particular from 40% by weight to 75% by weight, it being possible to replace this as desired, also in a certain proportion, with a water-soluble solvent component or for a water-soluble solvent component to be present additionally. Non-aqueous solvents which can be used in the liquid agents originate for example from the group of monovalent or polyvalent alcohols, alkanolamines or glycol ethers, provided they can be mixed with water in the specified concentration range. The solvents are preferably selected from ethanol, n- or i-propanol, butanols, ethylene glycol, butanediol, glycerol, diethylene glycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether or propylene glycol propyl ether, dipropylene glycol monomethyl ether or diproylene glycol monoethyl ether, diisopropylene glycol mono methyl ether or diisoproylene glycol mono ethyl ether, methoxytriglycol, ethoxytriglycol or butoxytriglycol, 1-butoxyethoxy-2-propanol, 3-methyl-3-methoxy butanol, propylene glycol-t-butyl ether and mixtures thereof. The quantity of the non-aqueous water-soluble solvent component in relation to the total quantity of the detergent and cleaning agent is preferably up to 15% by weight, in particular 0.5% by weight to 10% by weight.

The liquid detergents contain a surfactant, wherein anionic, non-ionic, cationic and/or amphoteric surfactants can be used. The presence of anionic surfactants is preferred, mixtures of anionic and non-ionic surfactants being particularly advantageous from an application viewpoint. The total surfactant content of the liquid agent preferably lies in the range from 10% by weight to 60% by weight, in particular 15% by weight to 50% by weight, in each case in relation to the total liquid agent.

Alcohol alkoxylates are preferably used as non-ionic surfactants, i.e. alkoxylated, advantageously ethoxylated, in particular primary alcohols containing preferably 8 to 18 C atoms and on average 1 to 12 mol of ethylene oxide (EO) per mol of alcohol, in which the alcohol group can be linear or preferably methyl-branched in the 2-position or can contain linear and methyl-branched groups in the mixture, as are normally present in oxo alcohol groups. However, alcohol ethoxylates with linear groups formed of alcohols of native origin containing 12 to 18 C atoms, for example formed of coconut alcohol, palm alcohol, tallow fatty alcohol or oleyl alcohol, and containing on average 2 to 8 EO per mol of alcohol, are preferred in particular. By way of example, the preferred ethoxylated alcohols include $C_{12-14}$ alcohols containing 3 EO, 4 EO or 7 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO, and mixtures thereof, such as mixtures of $C_{12-14}$ alcohol containing 3 EO and $C_{12-18}$ alcohol containing 7 EO. The specified degrees of ethoxylation are statistical average values, which can be an integer or a fractional number for a particular product. Preferred alcohol ethoxylates have a narrowed homologue distribution ("narrow range ethoxylates", NRE). In addition to these non-ionic surfactants, fatty alcohols containing more than 12 EO can also be used. Examples of these include tallow fatty alcohol containing 14 EO, 25 EO, 30 EO or 40 EO. Non-ionic surfactants that contain the EO and PO groups together in the molecule can also be used in accordance with the invention. Here, block copolymers with EO-PO block units or PO-EO block units can be used, but also EO-PO-EO copolymers or PO-EO-PO copolymers. Alkoxylated, non-ionic surfactants can also be used in mixed form, in which EO and PO units are not distributed in blocks, but statistically. Such products are obtainable by simultaneous action of ethylene oxide and propylene oxide on fatty alcohols.

In addition, alkyl glycosides can also be used as non-ionic surfactants, in particular alkyl glycosides of general formula $RO(G)_x$, in which R is a primary straight-chain or methyl-branched aliphatic group, in particular methyl-branched in the 2-position, containing 8 to 22, preferably 12 to 18, C atoms, and G is the symbol that stands for a glycose unit containing 5 or 6 C atoms, preferably for glucose. The degree of oligomerization x, which specifies the distribution of monoglycosides and oligoglycosides, is any number between 1 and 10; x is preferably between 1.2 and 1.4.

A further class of preferably used non-ionic surfactant, which are used either as sole non-ionic surfactant or in combination with other non-ionic surfactants, is constituted by alkoxylated, preferably ethoxylated or ethoxylated and propoxylated fatty acid alkyl esters, preferably containing 1 to 4 carbon atoms in the alkyl chain, in particular fatty acid methyl esters.

Non-ionic surfactants of the amine oxide type, for example N-coco alkyl-N,N-dimethylamine oxide and N-tallow alkyl-N,N-dihydroxyethylamine oxide, and of the fatty acid alkanolamide type, may also be suitable. The quantity of these non-ionic surfactants is preferably no more than that of the alcohol alkoxylates, in particular no more than half thereof.

Further suitable non-ionic surfactants are polyhydroxy fatty acid amides of formula (I)

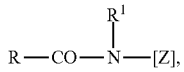

(I)

in which RCO stands for an aliphatic acyl group containing 6 to 22 carbon atoms, R1 stands for hydrogen, an alkyl group or hydroxyalkyl group containing 1 to 4 carbon atoms, and [Z] stands for a linear or branched polyhydroxyalkyl group containing 3 to 10 carbon atoms and 3 to 10 hydroxyl groups. The polyhydroxy fatty acid amides are known substances, which can normally be obtained by reductive amination of a reducing sugar with ammonia, an alkyl amine or an alkanol amine and subsequent acylation with a fatty acid, a fatty acid alkyl ester or a fatty acid chloride. The group of polyhydroxy fatty acid amides also includes compounds of formula (II)

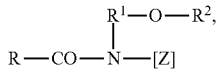

(II)

in which R stands for a linear or branched alkyl or alkenyl group containing 7 to 12 carbon atoms, $R^1$ stands for a linear, branched or cyclic alkyl group or an aryl group containing 2 to 8 carbon atoms, and $R^2$ stands for a linear, branched or cyclic alkyl group or an aryl group or an oxo alkyl group containing 1 to 8 carbon atoms, $C_{1-4}$ alkyl groups or phenyl groups being preferred, and [Z] stands for a linear polyhydroxyalkyl group, of which the alkyl chain is substituted with at least two hydroxyl groups, or alkoxylated, preferably ethoxylated or propoxylated derivatives of this group. [Z] is preferably obtained by reductive amination of a sugar, for example glucose, fructose, maltose, lactose, galactose, mannose or xylose. The N-alkoxy-substituted or N-aryloxy-substituted compounds can then be converted into the desired polyhydroxy fatty acid amides by reaction with fatty acid methyl esters in the presence of an alkoxide as catalyst.

The content of non-ionic surfactants in the liquid detergents is preferably 5% by weight to 30% by weight, in particular 7% by weight to 20% by weight, and particularly preferably 9% by weight to 15% by weight, in each case in relation to the total agent. In a preferred embodiment, the non-ionic surfactant is selected from alcohol alkoxylate and alkyl polyglycoside and the mixtures thereof.

By way of example, surfactants of the sulfonate and sulfate type can be used as anionic surfactants. Here, possible surfactants of the sulfonate type are preferably $C_{9-13}$ alkyl benzene sulfonates, olefin sulfonates, i.e. mixtures of alkene and hydroxyalkane sulfonates, and also disulfonates, as are obtained for example from $C_{12-18}$ monoolefins with terminal or internal double bond by sulfonation with gaseous sulfur trioxide and subsequent alkaline or acidic hydrolysis of the sulfonation products. Alkane sulfonates that are obtained from $C_{12-18}$ alkanes for example by sulfo-chlorination or sulfoxidation with subsequent hydrolysis or neutralization are also suitable. Also, the esters of α-sulfo fatty acids (ester sulfonates), for example the α-sulfonated methyl esters of hydrogenated coconut fatty acids, palm kernel fatty acids or tallow fatty acids are also suitable.

Further suitable anionic surfactants are sulfonated fatty acid glycerol esters. Fatty acid glycerol esters are understood to be the monoesters, diesters and triesters and also the mixtures thereof, as are obtained in the production by esterification of a monoglycerol containing 1 to 3 mol of fatty acid or in the reesterification of triglycerides containing 0.3 to 2 mol of glycerol. Here, preferred sulfonated fatty acid glycerol esters are the sulfonation products of saturated fatty acids containing 6 to 22 carbon atoms, for example of caproic acid, caprylic acid, capric acid, myristic acid, lauric acid, palmitic acid, stearic acid or behenic acid.

The alkaline salts and in particular the sodium salts of the sulfuric acid semi-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of the $C_{10}$-$C_{20}$ oxo alcohols and those semi-esters of secondary alcohols of these chain lengths are preferred as alk(en)yl sulfates. Alk(en)yl sulfates of the specified chain length that contain a synthetic straight-chain alkyl group produced on petrochemical basis, and that have a degradation behavior similar to the suitable compounds based on fatty chemical raw materials, are further preferred. The $C_{12}$-$C_{16}$ alkyl sulfates and $C_{12}$-$C_{15}$ alkyl sulfates and also $C_{14}$-$C_{15}$ alkyl sulfates are preferred from a washing viewpoint. 2,3-alkyl sulfates, which for example can be obtained as commercial products from the Shell Oil Company under the name DAN®, are also suitable anionic surfactants.

The sulfuric acid monoesters of the above-mentioned alcohol alkoxylates, for example of the straight-chain or branched $C_{7-21}$ alcohols ethoxylated with 1 to 6 mol of ethylene oxide, such as 2-methyl-branched $C_{9-11}$ alcohols containing on average 3.5 mol of ethylene oxide (EO) or $C_{12-18}$ fatty alcohols containing 1 to 4 EO, are also suitable. These are often also referred to as ether sulfates.

Further suitable anionic surfactants are also the salts of alkyl sulfosuccinic acid, which are also referred to as sulfosuccinates or as sulfosuccinate acid esters and represent the monoesters and/or diesters of sulfosuccinic acid containing alcohols, preferably fatty alcohols and in particular ethoxylated fatty alcohols. Preferred sulfosuccinates contain $C_{8-18}$ fatty alcohol groups or mixtures thereof. In particular, preferred sulfosuccinates contain a fatty alcohol group that derives from ethoxylated fatty alcohols, which, in themselves, represent non-ionic surfactants (see description below). Here, sulfosuccinates of which the fatty alcohol groups derive from ethoxylated fatty alcohols with narrowed homologue distribution are particularly preferred. It is also possible to use alk(en)yl succinic acid containing preferably 8 to 18 carbon atoms in the alk(en)yl chain, or the salts thereof.

Preferred anionic surfactants are soaps. Saturated and unsaturated fatty acid soaps are suitable, such as the salts of lauric acid, myristic acid, palmitic acid, stearic acid, (hydrogenated) erucic acid and behenic acid and also in particular soap mixtures derived from natural fatty acids, for example coconut fatty acids, palm kernel fatty acids, olive oil fatty acids or tallow fatty acids. In a preferred embodiment, the detergent contains 2% by weight to 20% by weight, in particular 3% by weight to 15% by weight, and particularly preferably 5% by weight to 10% by weight, of fatty acid soap. Fatty acid soaps are a key component for the washing power of a liquid, in particular aqueous, detergent and cleaning agent. It has surprisingly been found that, when using the low-methylated carboxymethyl cellulose ether, clear and stable liquid detergents are obtained even in the presence of a high quantity of fatty acid soap. The use of high quantities (≥2% by weight) of fatty acid soap in such systems usually leads to cloudy and/or unstable products.

The anionic surfactants, including soaps, can be present in the form of their sodium, potassium or ammonium salts and also as soluble salts or organic bases, such as monoethanolamine, diethanolamine or triethanolamine. The anionic surfactants are preferably present in the form of their sodium or potassium salts, in particular in the form of the sodium salts.

The content of anionic surfactants in preferred liquid detergents is 5% by weight to 35% by weight, in particular 8% by weight to 30% by weight, and particularly preferably 10% by weight to 25% by weight, in each case in relation to the total agent. It is particularly preferable if the quantity of fatty acid soap is at least 2% by weight, particularly preferably at least 3% by weight, and in particular from 4% by weight to 10% by weight. In a further preferred embodiment, the agents contain at least 2, in particular 3, different anionic surfactants, selected from alkylbenzene sulfonate, ether sulfate and fatty acid soap.

The detergent can contain a polyacrylate acting as cobuilder and optionally also acting as thickening agent. The polyacrylates include polyacrylate or polymethacrylate thickening agents, such as the high-molecular homopolymers of acrylic acid, cross-linked with a polyalkenyl polyether, in particular an allyl ether of sucrose, pentaerythrite or propylene, (INCI name according to "International Dictionary of Cosmetic Ingredients" of "The Cosmetic, Toiletry and Fragrance Association (CTFA)": Carbomer), which are also referred to as carboxyl vinyl polymers. Such polyacrylic acids are obtainable, inter alia, from the company 3V Sigma under the trade name Polygel®, for example Polygel DA, and from the company Noveon under the trade name Carbopol®, for example Carbopol 940 (molecular weight approximately 4,000,000), Carbopol 941 (molecular weight approximately 1,250,000) or Carbopol 934 (molecular weight approximately 3,000,000). Furthermore, the following acrylic acid copolymers also fall within this category: (i) copolymers of two or more monomers from the group of acrylic acid, methacrylic acid and the single esters thereof, preferably formed with $C_{1-4}$ alkanols, (INCI Acrylates Copolymer), which include for example the copolymers of methacrylic acid, butylacrylate and methyl methacrylate (CAS name according to Chemical Abstracts Service: 25035-69-2) or of butylacrylate and methyl methacrylate (CAS 25852-37-3) and which are obtainable for example from the company Rohm & Haas under the trade names Aculyn® and Acusol® and also from the company Degussa (Goldschmidt) under the trade name Tego® Polymer, for example the anionic non-associative polymers Aculyn 22, Aculyn 28, Aculyn 33 (cross-linked), Acusol 810, Acusol 823 and Acusol 830 (CAS 25852-37-3); (ii) cross-linked high-molecular acrylic acid copolymers, which include for example the copolymers, cross-linked with an allyl ether of sucrose or pentaerythrite, of $C_{10-30}$ alkyl acrylates having one or more monomers from the group of acrylic acid, methacrylic acid and the single esters thereof, preferably formed with $C_{1-4}$ alkanols, (INCI Acrylates/C10-30 Alkyl Acrylate Crosspolymer) and which are obtainable for example from the company Noveon under the trade name Carbopol®, for example the hydrophobed Carbopol ETD 2623 and Carbopol 1382 (INCI Acrylates/C10-30 Alkyl Acrylate Crosspolymer) and also Carbopol Aqua 30 (former Carbopol EX 473). Preferred liquid detergents contain the polyacrylate in a quantity of up to 5% by weight, in particular from 0.1% by weight to 2.5% by weight. It is advantageous when the polyacrylate is a copolymer of an unsaturated monocarboxylic or dicarboxylic acid and of one or more $C_1$-$C_{30}$ alkyl esters of (meth)acrylic acid.

The viscosity of the liquid detergents and cleaning agents can be measured using conventional standard methods (for example Brookfield viscometer LVT-II at 20 rpm and 20° C., spindle 3) and preferably lies in the range from 150 mPas to 5000 mPas. Preferred agents have viscosities from 500 mPas to 4000 mPas, values from 1000 mPas to 3500 mPas being particularly preferred.

In addition, the liquid detergents may contain further constituents which further improve the application-related and/or aesthetic properties thereof. Within the scope of the present invention, preferred agents contain one or more substances from the group of builders, bleaching agents, bleach activators, enzymes, electrolytes, pH adjusters, fragrances, perfume carriers, fluorescence agents, dyes, hydrotopes, foam inhibitors, additional anti-redeposition agents or anti-greying agents, optical brighteners, shrinkage inhibitors, anti-crease agents, color transfer inhibitors, antimicrobial active ingredients, germicides, fungicides, antioxidants, corrosion inhibitors, antistatic agents, ironing aids, repellants and impregnating agents, swelling and antislip agents, and also UV absorbers.

In particular silicates, aluminum silicates (in particular zeolites), carbonates, salts of organic di- and polycarboxylic acids and mixtures of these substances can be cited as builders that can be contained in the liquid agents.

Suitable crystalline, layered sodium silicates have the general formula $NaMSi_xO_{2x+1}.H_2O$, where M means sodium or hydrogen, x is a number from 1.9 to 4, and y is a number from 0 to 20, and preferred values for x are 2, 3 or 4. Preferred crystalline sheet silicates of the specified formula are those in which M stands for sodium and x assumes the value 2 or 3. In particular, both β- and δ-sodium silicates $Na_2Si_2O_5.yH_2O$ are preferred.

Amorphous sodium silicates with a module $Na_2O:SiO_2$ from 1:2 to 1:3.3, preferably from 1:2 to 1:2.8, and in particular from 1:2 to 1:2.6, which demonstrate a delay in dissolution and have secondary washing properties, can also be used. The delay in dissolution compared with conventional amorphous sodium silicates may have been caused here in various ways, for example by surface treatment, compounding, compaction/compression or by overdrying. Within the scope of this invention, the term "amorphous" is also understood to mean "X-ray amorphous". This means that, in X-ray diffraction experiments, the silicates do not provide sharp X-ray reflections as are typical for crystalline substances, but at most one or more maxima of the scattered X-ray radiation, which have a width of several degree units of the diffraction angle. However, particularly good builder properties may even be provided when the silicate particles in electron diffraction experiments deliver blurred or even sharp diffraction maxima. This is to be interpreted such that the products have microcrystalline regions measuring from 10 to a few hundred nm in size, values of up to at most 50 nm and in particular up to at most 20 nm being preferred. Such so-called X-ray amorphous silicates likewise have a delay in dissolution compared with the conventional water glasses. Compressed/compacted amorphous silicates, compounded amorphous silicates and overdried X-ray amorphous silicates are preferred in particular.

The used fine-crystalline, synthetic zeolite containing bound water is preferably zeolite A and/or P. Zeolite MAP® (commercial product from the company Crosfield) is particularly preferred as zeolite P. However, zeolite X and mixtures of A, X and/or P are also suitable. By way of example, a co-crystallizate formed of zeolite X and zeolite A (approximately 80% by weight zeolite X), which is marketed by the company SASOL under the trade name VEGOBOND AX® and can be described by the formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}$$

with n=0.90-1.0, is also commercially available and can be used with preference within the scope of the present invention. The zeolite can be used as a spray-dried powder or also as undried, stabilized suspension, which is still moist from its production. In the case that the zeolite is used as suspension, this may contain small additions of non-ionic surfactants as stabilizers, for example 1 to 3% by weight, in relation to zeolite, of ethoxylated $C_{12}$-$C_{18}$ fatty alcohols containing 2 to 5 ethylene oxide groups, $C_{12}$-$C_{14}$ fatty alcohols containing 4 to 5 ethylene oxide groups or ethoxylated isotridecanols. Suitable zeolites have a mean particle size of less than 10 μm (volume distribution; measurement method: Coulter Counter) and preferably contain 18 to 22% by weight, in particular 20 to 22% by weight, of bound water.

A use of the generally known phosphates as builder substances is also possible, provided such a use is not to be avoided for ecological reasons. The sodium salts of orthophosphates, pyrophosphates and in particular of tripolyphosphates are suitable in particular.

Among the compounds serving as bleaching agents, delivering $H_2O_2$ in water, sodium perborate tetrahydrate and sodium perborate monohydrate are of particular significance. Further usable bleaching agents include, for example, sodium percarbonate, peroxypyrophosphates, citrate perhydrates and also peracid salts or peracids delivering $H_2O_2$, such as perbenzoates, peroxophthalates, diperazelaic acid, phthaloiminoperacid or diperdodecanedioic acid. If present, these are preferably used in wrapped form so as to be protected against degradation during storage.

In order to achieve an improved bleaching effect when washing at temperatures of 60° C. and below, bleach activators can be incorporated into the detergents and cleaning agents. Compounds that, under perhydrolysis conditions, produce aliphatic peroxocarboxylic acids containing preferably 1 to 10 C atoms, in particular 2 to 4 C atoms, and/or optionally substituted perbenzoic acid, can be used as bleach activators. Substances that carry the O- and/or N-acyl groups of the specified C atom number and/or optionally substituted benzoyl groups are suitable. Alkylene diamines acylated a number of times, in particular tetraacetylethylenediamine (TAED), acylated triazine derivatives, in particular 1,5-diacetyl-2,4-dioxo-hexahydro-1,3,5-triazine (DADHT), acylated glycol urils, in particular tetraacetyl glycoluril (TAGU), N-acylimides, in particular N-nonanoyl succinimide (NOSI), acylated phenol sulfonates, in particular n-nonanoyl oxybenzenesulfonate or isononanoyl oxybenzenesulfonate (n- or iso-NOBS), carboxylic acid anhydrides, in particular phthalic acid anhydride, acylated polyvalent alcohols, in particular triacetine, ethylene glycol diacetate and 2,5-diacetoxy-2,5-dihydrofuran, are preferred.

In addition to the conventional bleach activators, or instead of these, so-called bleach catalysts can also be incorporated into the liquid detergents and cleaning agents. These substances are bleach-intensifying transition metal salts or transition metal complexes, such as Mn, Fe, Co, Ru or Mo salen complexes or carbonyl complexes. Mn, Fe, Co, Ru, Mo, Ti, V and Cu complexes with nitrogen-containing tripod ligands and also Co, Fe, Cu and Ru ammine complexes can also be used as bleach catalysts.

In particular, possible enzymes are those from the classes of hydrolases such as proteases, esterases, lipases or lipolytically acting enzymes, amylases, cellulases or other glycosyl hydrolases and mixtures of the aforementioned enzymes. All of these hydrolases contribute in the laundry to the removal of stains, such as stains and greying containing protein, fat or starch. Cellulases and other glycosyl hydrolases can additionally contribute, by means of the removal of pilling and microfibrils, to color retention and to an increase of the softness of the textile. Oxireductases can also be used for bleaching and in order to inhibit color transfer. Enzymatic active ingredients obtained from bacteria strains or fungi such as *Bacillus subtilis, Bacillus licheniformis, Streptomyces griseus* and *Humicola insolens* are particularly well suited. Proteases of the subtilisin type and in particular proteases that are obtained from *Bacillus lentus* are preferably used. Here, enzyme mixtures, for example from protease and amylase or protease and lipase or lipolytically acting enzymes or protease and cellulase or from cellulase and lipase or lipolytically acting enzymes or from protease, amylase and lipase or lipolytically acting enzymes or protease, lipase or lipolytically acting enzymes and cellulase, but in particular protease and/or lipase-containing mixtures or mixtures containing lipolytically acting enzymes are of particular interest. Examples of such lipolytically acting enzymes are the known cutinases. Peroxidases or oxidases have also proven to be suitable in some cases. In particular, the suitable amylases include α-amylases, iso-amylases, pullulanases and pectinases. Cellobiohydrolases, endoglucanases and β-glucosidases, which are also referred to as cellobiases, or mixtures thereof are preferably used as cellulases. Since different cellulase types differ by their CMCase and avicelase activities, the desired activities can be adjusted by selective mixtures of the cellulases.

The bleach activators, bleach catalysts and/or enzymes can be adsorbed on carrier substances and/or wrapped so as to be protected against premature degradation. The proportion of enzymes, enzyme liquid formulations, enzyme mixtures or enzyme granulates can be, for example, approximately 0.1% by weight to 5% by weight, preferably 0.12% by weight to approximately 2.5% by weight, in each case in relation to the total agent.

A wide number of different salts can be used as electrolytes from the group of inorganic salts. Preferred cations are the alkaline and alkaline earth metals, preferred anions are the halides and sulfates. In terms of production, the use of NaCl or $MgCl_2$ in the agents is preferred. The proportion of electrolytes in the agents is normally no more than 8% by weight, in particular 0.5% by weight to 5% by weight.

In order to bring the pH value of the liquid agents into the desired range, the use of pH adjusters may be indicated. Here, all known acids and lyes can be used, provided the use thereof is not prohibited for application-related or ecological reasons or for reasons of consumer protection. The quantity of these adjusters normally does not exceed 10% by weight of the total formulation.

A further component of detergents according to the invention that is contained if desired is a hydrotrope. Preferred hydrotropes comprise the sulfonated hydrotropes, such as alkylaryl sulfonates or alkylaryl sulfonic acids. Preferred hydrotropes are selected from xylene sulfonate, toluene sulfonate, cumene sulfonate, naphthalene sulfonate or xylene sulfonic acid, toluene sulfonic acid, cumene sulfonic acid, naphthalene sulfonic acid, and mixtures thereof. Counterions are preferably selected from sodium, calcium and ammonium. The liquid agents can optionally comprise up to 20% by weight of a hydrotrope, in particular 0.05% by weight to 10% by weight.

In order to improve the aesthetic impression of the liquid agents, they can be colored using suitable dyes. Preferred dyes, of which the selection will not pose any difficulty to a person skilled in the art, have high storage stability and are not sensitive to the other constituents of the agents or to light and also do not have any pronounced substantivity with respect to textile fibers so as not to color these.

For example, soaps, paraffins or silicone oils that, where appropriate, could also have been applied to carrier materials, can be considered as foam inhibitors that can be used in the liquid detergents and cleaning agents.

Suitable additional anti-redeposition agents, which are also referred to as "soil repellents", are, for example, the polymers, known from the prior art, of phthalic acid and/or terephthalic acid or of the derivatives thereof, in particular polymers from ethylene terephthalates and/or polyethylene glycol terephthalates or anionically and/or non-ionically modified derivatives thereof. Among these, the sulfonated derivatives of phthalic acid polymers and terephthalic acid polymers are particularly preferred.

Optical brighteners can be added to the liquid detergents and cleaning agents so as to remove yellowing of the treated textile fabrics. These substances are drawn onto the fiber and have a brightening effect by converting ultraviolet radiation, which is not visible to the human eye, into visible light of longer wavelength, the ultraviolet light absorbed from the sunlight being irradiated as faint bluish fluorescence and resulting in pure white together with the yellow tone of yellowed laundry. Suitable compounds originate for example from the substance classes of 4,4'-diamino-2,2'-stilbenedisulfonic acids (flavonic acids), 4,4'-distyrylbiphenylene, methylumbelliferones, cumarins, dihydroquinolinones, 1,3-diarylpyrazolines, naphthalene acid amides, benzoxazole systems, benzisoxazole systems and benzimidazole systems and also the pyrene derivatives substituted by heterocyclene. Optical brighteners are normally used in quantities of up to 0.5% by weight, in particular from 0.03% by weight to 0.3% by weight, in relation to the finished agent.

Since textile fabrics, in particular those formed from rayon, spun rayon, cotton and the mixtures thereof, can tend toward creasing because the individual fibers are sensitive to deflection, bending, pressing and crushing transversely to the fiber direction, the agents may contain synthetic anti-creasing agents. These include, for example, synthetic products on the basis of fatty acids, fatty acid esters, fatty acid amides, fatty acid alkylol esters, fatty acid alkylol amides or fatty alcohols, which are usually reacted with ethylene oxide, or products based on lecithin or modified phosphoric acid ester.

In order to control microorganisms, the liquid detergents and cleaning agents may contain antimicrobial active ingredients. Here, a distinction is made on the basis of antimicrobial spectrum and mechanism of action between bacteriostatics and bactericides, fungistatics and fungicides, etc. Key substances from these groups include, for example, benzalkonium chlorides, alkylaryl sulfonates, halogen phenols and phenolmercuriacetate, wherein these compounds can also be completely dispensed with in the agents according to the invention.

In order to prevent undesirable modifications to the liquid detergents and cleaning agents and/or the treated textile fabrics, caused by the action of oxygen and other oxidative processes, the agents can contain antioxidants. This compound class includes, for example, substituted phenols, hydroquinones, catechols and aromatic amines and also organic sulfides, polysulfides, dithiocarbamates, phosphites and phosphonates. When using such antioxidants, the agents according to the invention are naturally free from oxidizing bleaching agents.

An increased wearing comfort can result from the additional use of antistatic agents, which are additionally added to the agents. Antistatic agents increase the surface conductivity and thus enable an improved run-off of formed charges. External antistatic agents are generally substances having at least one hydrophilic molecule ligand and provide a more or less hygroscopic film on the surfaces. These antistatic agents, which are mostly surface-active, can be divided into nitrogen-containing antistatic agents (amines, amides, quaternary ammonium compounds), phosphorous-containing antistatic agents (phosphoric acid esters) and sulfur-containing antistatic agents (alkyl sulfonates, alkyl sulfates). External antistatic agents include, for example, lauryl (or stearyl) dimethylbenzyl ammonium chlorides, which are suitable as antistatic agents for textile fabrics or as additive to detergents, wherein a brightening effect is attained in addition.

In order to improve the water absorption capacity and the re-wettability of the treated textile fabrics and in order to facilitate ironing of the treated textile fabrics, silicone derivatives for example can be used in the liquid detergents and cleaning agents. These additionally improve the rinse-out behavior of the agents on account of their foam-inhibiting properties. Preferred silicone derivatives include, for example, polydialkyl siloxanes or alkylaryl siloxanes, in which the alkyl groups contain one to five C atoms and are fully or partially fluorinated. Preferred silicones are polydimethyl siloxanes, which can be derivatized where appropriate and then are amino-functional or quaternated or contain Si—OH bonds, Si—H bonds and/or Si—Cl bonds. The viscosities of the preferred silicones at 25° C. are in the range between 100 and 100,000 mPas, wherein the silicones can be used in quantities between 0.2 and 5% by weight, in relation to the total agent.

Lastly, the liquid detergents and cleaning agents may also contain UV absorbers, which are drawn onto the treated textile fabric and improve the light resistance of the fibers. Compounds that have these desired properties include, for example, the compounds and derivatives, effective by radiation-free deactivation, of benzophenone with substituents in the 2- and/or 4-position. Furthermore, substituted benzotriazoles, acrylates which are phenyl-substituted in the 3-position (cinnamic acid derivatives), possibly with cynao groups in the 2-position, salicylates, organic Ni-complexes and also natural substances, such as umbelliferone and urocanic acid, are also suitable.

To prevent the heavy metal-catalyzed decomposition of certain detergent constituents, substances that complex heavy metals may be used. Suitable heavy metal complexing agents include, for example, the alkaline salts of ethylenediaminetetraacetic acid (EDTA) or of nitrilotriacetic acid (NTA) as well as alkaline metal salts of anionic polyelectrolytes, such as polymaleates and polysulfonates.

The phosphonates, which are present in preferred liquid agents in quantities from 0.01% by weight to 2.5% by weight, preferably from 0.02% by weight to 2% by weight, and in particular from 0.03% by weight to 1.5% by weight, are a preferred class of complexing agents. These preferred compounds include in particular organophosphonates, such as 1-hydroxyethane-1,1-diphosphonic acid (HEDP), aminotri(methylene phosphonic acid) (ATMP), diethylenetriamine penta(methylene phosphonic acid) (DTPMP or DETPMP), as well as 2-phosphonobutane-1,2,4-tricarboxylic acid (PBSAM), which are usually used in the form of their ammonium or alkaline metal salts.

The liquid detergents are preferably clear, i.e., they do not have any sediment and are transparent or at least translucent. Without the addition of a dye, the liquid detergents preferably have a visible light transmission (410 to 800 nm) of at least 10%, in particular of at least 15%, and particularly preferably of at least 25%.

Besides the specified components, however, a liquid detergent and cleaning agent can also contain particles dispersed therein, of which the diameter along the greatest physical extent thereof is 100 μm to 10,000 μm, for example. Such particles can be both microcapsules or speckles and granulates, compounds and fragrance beads, wherein microcapsules or species are preferred.

The term "microcapsule" is understood to mean aggregates that contain at least one solid or liquid nucleus, which is encased by at least one continuous shell, in particular a shell formed of polymer(s). These are usually finely dispersed liquid or solid phases wrapped by film-forming polymers, during the production of which the polymers precipitate on the material to be wrapped following emulsification and coacervation or interfacial polymerization. The microscopically small capsules can be dried like powder. Besides mononuclear microcapsules, polynuclear aggregates, also referred to as microspheres, are also known, which contain two or more nuclei distributed in the continuous shell material. Mononuclear or polynuclear microcapsules may additionally be encased by an additional second, third, etc. shell.

Mononuclear microcapsules with a continuous shell are preferred. The shell can consist of natural, semi-synthetic or synthetic materials. Natural shell materials are, for example gum arabic, agar agar, agarose, maltodextrin, alginic acid or the salts thereof, for example sodium alginate or calcium alginate, fats and fatty acids, cetyl alcohol, collagen, chitosan, lecithin, gelatin, albumin, shellac, polysaccharides, such as starch or dextran, sucrose and waxes. Semi-synthetic shell materials include, inter alia, chemically modified celluloses, in particular cellulose esters and ethers, for example cellulose acetate, ethyl cellulose, hydroxypropyl cellulose, hydroxypropyl methylcellulose and carboxymethyl cellulose, and also starch derivatives, in particular starch ethers and esters. Synthetic shell materials include, for example, polymers such as polyacrylates, polyamides, polyvinyl alcohol or polyvinylpyrrolidone.

Sensitive, chemically or physically incompatible and also volatile components (=active ingredients) of the liquid agent can be incorporated inside the microcapsules in a manner that remains stable during storage and transport. By way of example, optical brighteners, surfactants, complexing agents, bleaching agents, bleach activators, dyes and fragrances, antioxidants, builders, enzymes, enzyme stabilizers, antimicrobial active ingredients, anti-redeposition agents, pH adjusters, electrolytes, foam inhibitors and/or UV absorbers can be found in the microcapsules. In addition to the components mentioned above as constituents of the aqueous liquid agents according to the invention, the microcapsules may contain, for example, vitamins, proteins, preservatives, washing power enhancers or pearlizing agents. The fillings of the microcapsules can be solids or liquids in the form of solutions or emulsions or suspensions.

The microcapsules may have any form as a result of the production process, but are preferably approximately spherical. The diameter thereof along the greatest physical extent thereof can be between 0.01 μm (visually not discernible as capsule) and 10,000 μm, depending on the components contained in their interior and depending on the application. Visible microcapsules with a diameter in the range from 100 μm to 7,000 μm, in particular from 400 μm to 5,000 μm, are preferred. The microcapsules are accessible by methods known in the prior art, wherein coacervation and interfacial polymerization are the most significant. All surfactant-stable microcapsules offered on the market can be used as microcapsules, for example the commercial products (the shell material is specified between parentheses in each case) Hallcrest Microcapsules (gelatin, gum arabic), Coletica Thalaspheres (maritime collagen), Lipotec Millicapseln (alginic acid, agar agar), Induchem Unispheres (lactose, microcrystalline cellulose, hydroxypropyl methylcellulose); Unicerin C30 (lactose, microcrystalline cellulose, hydroxypropyl methylcellulose), Kobo Glycospheres (modified starch, fatty acid ester, phospholipids), Softspheres (modified agar agar) and Kuhs Probiol Nanospheres (phospholipids).

Alternatively, particles that have no nucleus-shell structure, but in which the active ingredient is distributed in a matrix formed of a matrix-forming material, can also be used. Such particles are also referred to as "speckles". A preferred matrix-forming material is alginate. In order to produce alginate-based speckles, an aqueous alginate solution, which also contains the active ingredient or active ingredients to be incorporated, is formed into drops and then cured in a precipitation bath containing $Ca^{2+}$ ions or $Al^{3+}$ ions. It may be advantageous for the alginate-based speckles to then be washed with water and then washed in an aqueous solution with a complexing agent in order to wash out free $Ca^{2+}$ ions or free $Al^{3+}$ ions which may enter into undesirable interactions with constituents of the liquid detergent, for example the fatty acid soaps. The alginate-based speckles are then washed with water so as to remove excess complexing agent. Alternatively, instead of alginate, other matrix-forming materials can be used. Examples of matrix-forming materials include polyethylene glycol, polyvinylpyrrolidone, polymethacrylate, polylysin, poloxamers, polyvinyl alcohol, polyacrylic acid, polyethylene oxide, polyethoxyoxazolin, albumin, gelatin, acacia, chitosan, cellulose, dextran, Ficoll®, starch, hydroxyethyl cellulose, hydroxypropyl cellulose, hydroxypropyl methylcellulose, hyaluronic acid, carboxymethyl cellulose, carboxymethyl cellulose, deacetylated chitosan, dextran sulfate, and derivatives of these materials. The matrix is formed in these materials for example via gelation, polyanion/polycation interactions or polyelectrolyte/metal ion interactions and is just as well known in the prior art as the production of particles containing these matrix-forming materials. The particles can be dispersed in a stable manner in the aqueous liquid detergents and cleaning agents. Stable means that the agents are stable at room temperature and at 40° C. over a period of time of at least 4 weeks and preferably of at least 6 weeks, without the agents creaming or forming sediment.

The active ingredients are usually released from the microcapsules or speckles during the application of the agents containing them by destruction of the shell or the matrix as a result of mechanical, thermal, chemical or enzymatic action. In a preferred embodiment of the invention, the liquid detergents contain the same or different particles in quantities from 0.01 to 10% by weight, in particular 0.2 to 8% by weight, and extremely preferably 0.5 to 5% by weight.

Aqueous detergents and cleaning agents can be produced inexpensively and easily in conventional mixing and filling systems. To produce the liquid agents, the acidic components, if present, such as the linear alkylsulfonates, citric acid, boric acid, phosphonic acid, the fatty alcohol ether sulfates and the non-ionic surfactants, are preferably provided first. The solvent component is preferably also added at this time, but the addition may also take place at a later point in time. If present, the complexing agent is added to these components. Then, a base such as NaOH, KOH, triethanolamine or monoethanolamine is added, followed by fatty acid, if present. Then, the remaining constituents and optionally the remaining solvents of the aqueous liquid agent are added to the mixture, and the pH value is adjusted to the desired value. In conclusion, if desired, the particles to be dispersed may be added and distributed homogeneously in the aqueous liquid agent by mixing.

EXAMPLES

Table 1 specifies the composition (constituents in % by weight, in each case in relation to the total agent) of the detergent M1 according to the invention and of the agents V1, V2, V3 and V4 not according to the invention produced for comparison. The agent M1 at 550 nm had a transmission of 18%, whereas the agents V3 and V4 at the same light wavelength had transmissions of just 1% and 7%, and the agent V1 had a transmission of 81%.

TABLE 1

| | V1 | Ml | V2 | V3 | V4 |
|---|---|---|---|---|---|
| $C_9$-$C_{13}$ alkylbenzene sulfonate, Na salt | 6 | 6 | 6 | 6 | 6 |
| sodium lauryl ether sulfate with 2 EO | 8 | 8 | 8 | 8 | 8 |
| $C_{12-14}$ fatty alcohol with 7 EO | 6 | 6 | 6 | 6 | 6 |
| $C_{12-18}$ fatty acid, Na salt | 3 | 3 | 3 | 3 | 3 |
| NaOH | 2 | 2 | 2 | 2 | 2 |
| citric acid | 2 | 2 | 2 | 2 | 2 |
| Phosphonate | 0.2 | 0.2 | 0.2 | 0.2 | 0.2 |
| Na-sulfoethyl cellulose[a)] | — | 1 | — | — | — |
| Na-sulfoethyl cellulose[b)] | — | — | 1 | — | — |
| Na-sulfoethyl cellulose[c)] | — | — | — | 1 | — |
| carboxymethyl cellulose | — | — | — | — | 1 |
| Water | | | to 100 | | |

[a)]substitution rate 0.51; $M_w$ 792,670 g/mol
[b)]substitution rate 0.21; $M_w$ 539,000 g/mol
[c)]substitution rate 1.14; $M_w$ 639,650 g/mol The agents were tested in a Miele® W 1714 washing machine (cotton washing program, 40° C.; water hardness 16° dH; soil carrier Greying Swatch; dosage 66 ml of the respective agent per washing cycle). Besides filling laundry, the following materials were used at a load of 3.5 kg (8 textile pieces in each case measuring 20×40 cm in size):

A 100% cotton, cotton cloth WFK 10A, without opt. brightener

B 100% cotton, cotton cloth WFK 12A, terry cloth, without opt. brightener

C 100% cotton, terry towel

D 100% cotton, bleached nettle fabric

E 100% cotton, Krefeld standard textile, without opt. brightener

F 100% cotton, double-ribbed material

G 100% cotton, cotton fabric EMPA 221

Table 2 specifies the brightness change (ΔY value) of the materials after 3 washes with the respective agent.

TABLE 2

| | M1 | V1 | V2 | V3 | V4 |
|---|---|---|---|---|---|
| A | −4.8 | −9.3 | −6.9 | −6.1 | −5.1 |
| B | −8.6 | −16.4 | −9.2 | −9.1 | −7.8 |
| C | −6.7 | −15.0 | −10.9 | −10.3 | −8.4 |
| D | −5.8 | −9.7 | −6.9 | −6.8 | −5.7 |
| E | −6.9 | −10.7 | −8.7 | −7.9 | −6.7 |
| F | −6.6 | −15.7 | −9.6 | −10.8 | −6.6 |
| G | −9.0 | −16.0 | −12.4 | −10.2 | −9.1 |

The superiority of the agent according to the invention compared with agents containing Na-sulfoethyl cellulose having different substitution rates is evident.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An aqueous liquid detergent comprising surfactant and an additional cleaning agent comprising sulfoethyl cellulose having a substitution rate of from 0.3 to 0.9 and/or the salt thereof, from 15% by weight of the agent to 50% by weight of the agent of surfactant, wherein said surfactant comprises from 5% by weight of the agent to 35% by weight of the agent of anionic surfactants, wherein said anionic surfactants comprise at least 3 different anionic surfactants selected from the group consisting of alkylbenzene sulfonate, ether sulfate and fatty acid soap, and wherein the agent further comprises water, or water with a water-soluble solvent, from 40% by weight of the agent to 85% by weight of the agent.

2. The detergent of claim 1, wherein the sulfoethyl cellulose and/or the salt thereof has a substitution rate of 0.4 to 0.7.

3. The detergent of claim 1, wherein the agent comprises 0.1% by weight to 5% by weight, of sulfoethyl cellulose and/or the salt thereof.

4. The detergent of claim 1, comprising a non-ionic surfactant.

5. The detergent of claim 1, comprising up to 75% by weight of water.

6. The detergent of claim 1, characterized in that it is transparent or at least translucent and, without addition of a dye, has a visible light transmission (410 to 800 nm) of at least 10%.

* * * * *